US012344989B2

(12) United States Patent
Reeves et al.

(10) Patent No.: US 12,344,989 B2
(45) Date of Patent: Jul. 1, 2025

(54) DRYER APPLIANCE WITH A SHEET DISPENSER

(71) Applicant: Haier US Appliance Solutions, Inc., Wilmington, DE (US)

(72) Inventors: Joshua Reeves, Louisville, KY (US); Sean Simpson, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 643 days.

(21) Appl. No.: 17/686,619

(22) Filed: Mar. 4, 2022

(65) Prior Publication Data

US 2023/0278816 A1 Sep. 7, 2023

(51) Int. Cl.
*D06F 58/20* (2006.01)
*B65H 3/06* (2006.01)

(52) U.S. Cl.
CPC ..... *D06F 58/203* (2013.01); *B65H 3/06* (2013.01); *B65H 2403/92* (2013.01); *B65H 2404/16* (2013.01); *B65H 2701/19* (2013.01)

(58) Field of Classification Search
CPC .... B65H 3/0684; B65H 3/0669; B65H 27/00; B65H 2403/92; B65H 2404/16; D06F 58/203
USPC ..... 221/42
See application file for complete search history.

(56) References Cited

U.S. PATENT DOCUMENTS 3,267,701 A * 8/1966 Mandarino ..... B05B 3/085 427/242
3,895,128 A * 7/1975 Gaiser ..... C11D 17/047 206/820
4,091,548 A * 5/1978 Daily ..... D06F 58/04 34/202
4,437,656 A * 3/1984 Onoda ..... B65H 3/0638 271/22
4,958,825 A * 9/1990 Onomoto ..... B65H 3/5215 271/119
5,083,765 A * 1/1992 Kringel ..... B65H 3/5238 271/118
5,411,164 A 5/1995 Smith et al.
5,577,612 A * 11/1996 Chesson ..... B65D 83/0894 229/232
5,787,606 A * 8/1998 Bokholdt ..... D06F 58/203 34/527
6,922,913 B2 * 8/2005 Hood ..... D06F 58/203 34/597
7,066,412 B2 6/2006 Conley et al.
7,182,332 B2 * 2/2007 Pittelkow ..... B65H 3/10 271/112
D622,989 S 9/2010 Lagler et al.
(Continued)

FOREIGN PATENT DOCUMENTS

JP H0632337 A * 2/1994 ..... B65C 9/1865
RU 2578112 C2 3/2016

*Primary Examiner* — Rakesh Kumar

(74) *Attorney, Agent, or Firm* — Dority & Manning, P.A.

(57) ABSTRACT

A sheet dispenser for a dryer appliance includes a housing that defines a storage volume and an outlet. The storage volume is configured for receipt of a plurality of dryer sheets for dispensing. A roller is mounted to the housing within the storage volume. A motor is coupled to the roller such that the motor is operable to rotate the roller. The roller is configured to urge the plurality of dryer sheets in the storage volume through the outlet of the housing when the motor rotates the roller.

14 Claims, 3 Drawing Sheets

(56) References Cited

U.S. PATENT DOCUMENTS

| | | | | |
|---|---|---|---|---|
| 8,914,989 | B2 | 12/2014 | Ghosh et al. | |
| 9,702,077 | B2 | 7/2017 | Doh | |
| 2003/0224962 | A1 | 12/2003 | Fryc | |
| 2010/0327004 | A1 | 12/2010 | Post | |
| 2011/0036855 | A1* | 2/2011 | Petocchi | A47K 10/3612 221/9 |
| 2012/0085673 | A1 | 4/2012 | White | |
| 2015/0302680 | A1* | 10/2015 | Guo | B65H 1/266 232/1 D |
| 2020/0238202 | A1* | 7/2020 | Renz | B01D 29/09 |
| 2021/0115618 | A1* | 4/2021 | Lee | B01D 46/0012 |
| 2023/0278816 | A1* | 9/2023 | Reeves | B65H 20/02 |
| 2023/0295864 | A1* | 9/2023 | Reeves | D06F 58/203 34/427 |

* cited by examiner

DRYER APPLIANCE WITH A SHEET DISPENSER

FIELD OF THE INVENTION

The present subject matter relates generally to dryer appliances, and more particularly to dryer appliances having one or more features for venting fluids (e.g., gases) from a drying chamber.

BACKGROUND OF THE INVENTION

Dryer appliances generally include a cabinet with a drum mounted therein. Prior to starting a drying cycle, a user may add a dryer sheet with chemical softeners, lubricants, fragrances etc. into the drum with the articles for drying. Generally, the user pulls one dryer sheet from a box of dryer sheets and manually places each dryer sheet within the drum. Such manual dispensing can be inconvenient and easily forgotten.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a dryer appliance includes a cabinet. A drum is rotatably mounted at the cabinet. The drum defines a drying chamber configured for receipt of articles for drying. A sheet dispenser is mounted within the cabinet. The sheet dispenser includes a housing that defines a storage volume and an outlet. The storage volume is configured for receipt of a plurality of dryer sheets for dispensing. The outlet is positioned contiguous with the drying chamber. A roller is mounted to the housing within the storage volume. A motor is coupled to the roller such that the motor is operable to rotate the roller. The roller is configured to urge the plurality of dryer sheets in the storage volume towards the drying chamber through the outlet of the housing when the motor rotates the roller.

In another exemplary aspect of the present disclosure, a sheet dispenser for a dryer appliance includes a housing that defines a storage volume and an outlet. The storage volume is configured for receipt of a plurality of dryer sheets for dispensing. A roller is mounted to the housing within the storage volume. A motor is coupled to the roller such that the motor is operable to rotate the roller. The roller is configured to urge the plurality of dryer sheets in the storage volume through the outlet of the housing when the motor rotates the roller.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
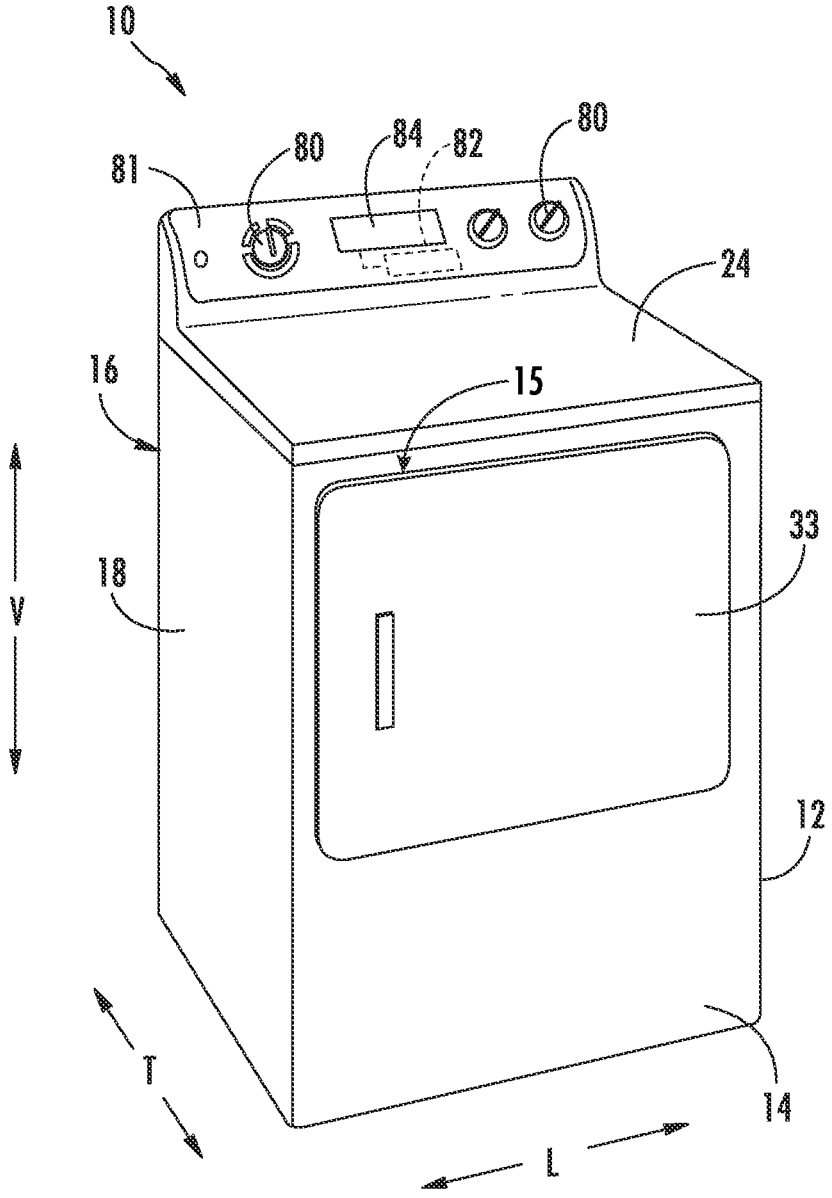
FIG. 1 is a perspective view of a dryer appliance in accordance with an example embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
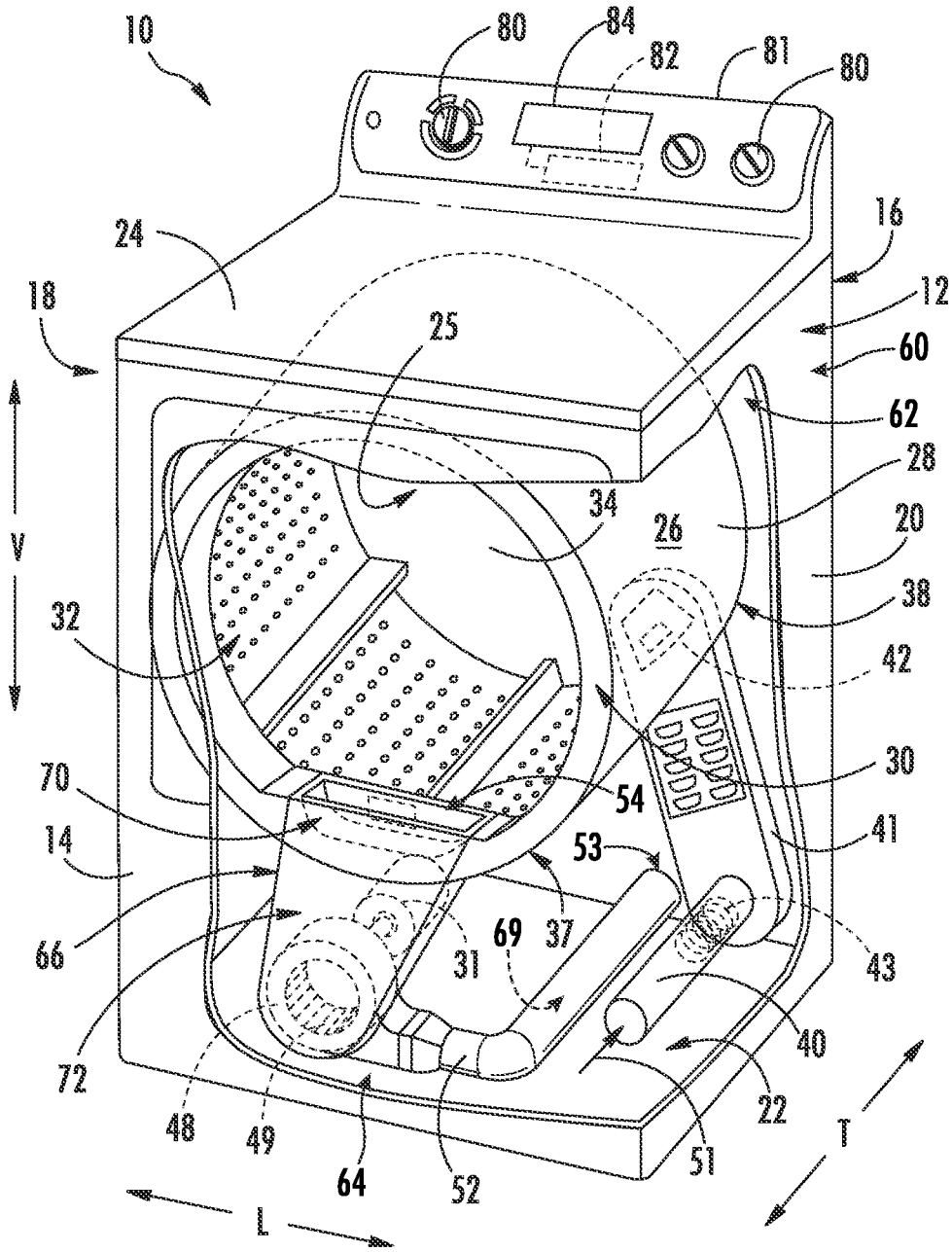
FIG. 2 is a perspective view of the example dryer appliance of FIG. 1, with portions of a cabinet of the example dryer appliance removed to reveal certain components of the example dryer appliance.

Turning now to the figures, FIG. 1 illustrates a dryer appliance 10 according to exemplary embodiments of the present disclosure. FIG. 2 provides another perspective view of dryer appliance 10 with a portion of a cabinet or housing 12 of dryer appliance 10 removed in order to show certain components of dryer appliance 10. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well.

Generally, dryer appliance 10 defines a vertical direction V, a lateral direction L, and a transverse direction T. The vertical direction V, lateral direction L, and transverse direction T are mutually perpendicular and form an orthogonal direction system. Cabinet 12 includes a front panel 14, a rear panel 16, a pair of side panels 18 and 20 spaced apart from each other by front and rear panels 14 and 16, a bottom panel 22, and a top cover 24. These panels can collectively define an external surface 60 of cabinet 12 and an interior 62 or internal volume 62 of cabinet 12. In some embodiments, one or more cabinet 12 openings are defined through cabinet 12. As an example, front panel 14 may define a front opening 15 through which articles may be received for drying. As an additional or alternative example, rear panel 16 may define a rear opening 17 in fluid communication with interior 62, such as to permit the exchange of air between the ambient environment and interior 62.

Within interior 62 of cabinet 12 is a drum or container 26. Drum 26 defines a chamber 25 for receipt of articles (e.g., clothing, linen, etc.) for drying. Drum 26 extends between a front end 37 and a rear portion 38 (e.g., along the transverse direction T). In exemplary embodiments, drum 26 is rotatable, for instance, about an axis that is parallel to the transverse direction T, within cabinet 12.

Drum 26 may be generally cylindrical in shape, having an outer cylindrical wall or cylinder 28 and a front wall 30 that may define a dryer opening or entry 32 of drum 26 (e.g., at front end 37 of drum 26) for loading and unloading of articles into and out of chamber 25 of drum 26. As shown, entry 32 may be aligned with an opening 15 of cabinet 12 through front panel 14, which is selectively covered by door 33. Opposite of the entry 32, drying chamber 25 may be substantially closed. For instance, drum 26 may include a back or rear wall 34 (e.g., at back end 38 of drum 26). As is generally understood, the front wall 30 and rear wall 34 remain generally stationary during operation of the dryer appliance 10. The cylinder 28 is rotatable relative to the drum 26 (including the front wall 30 and rear wall 34), such as about a central longitudinal axis of the cylinder 28 which in exemplary embodiments as shown extends parallel to the transverse direction T.

Figure 4:
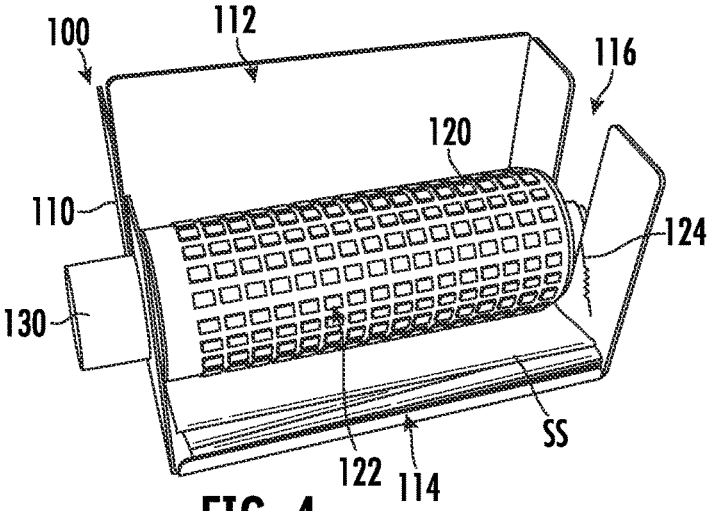
FIG. 4 is a perspective view of a sheet dispenser of the example dryer appliance of FIG. 3.

A blower motor 31 may be in mechanical communication with an air handler (e.g., blower 48). During certain operations, motor 31 may rotate a blower fan or impeller 49 of blower 48. Blower 48 is configured for drawing air through chamber 25 of drum 26 (e.g., in order to dry articles located therein). As illustrated in FIG. 4, dryer appliance 10 may include an additional motor (e.g., drum motor 35) in mechanical communication with drum 26. In turn, motor 35 may rotate drum independently of blower 48.

Drum 26 may be configured to receive heated air that has been heated by a heating assembly 40 (e.g., in order to dry damp articles disposed within chamber 25 of drum 26). Generally, heating assembly 40 includes a heater 43, such as a gas burner or an electrical resistance heating element, for heating air. As discussed above, during operation of dryer appliance 10, motor 31 rotates impeller 49 of blower 48 such that blower 48 draws air through chamber 25 of drum 26. In particular, ambient air enters heating assembly 40 via an entrance (e.g., as indicated at arrow 51) due to blower 48 urging such ambient air into entrance. Such ambient air is heated within heating assembly 40 and exits heating assembly 40 as heated air. Blower 48 draws such heated air through inlet duct 41 to drum 26. In particular, the heated air enters drum 26 through an outlet 42 of duct 41. Thus, outlet 42 may be positioned at rear wall 34 of drum 26.

Within chamber 25, the heated air can remove moisture (e.g., from damp articles disposed within chamber 25). This internal air, in turn, flows from chamber 25 through a ventilation assembly 64 positioned within interior 62. Generally, ventilation assembly 64 includes an exhaust conduit 52 that defines an exhaust passage 69. Exhaust passage 69 is in fluid communication with the drying chamber 25 and extends from an inlet 54 at drying chamber 25 to an outlet 53 defined by cabinet 12. In some embodiments, the exhaust conduit 52 includes a vent duct 66, blower 48, and a ducted conduit 68. As shown, exhaust conduit 52 may be configured in fluid communication with vent duct 66 via blower 48. During a dry cycle, internal air flows from chamber 25 through vent duct 66 to blower 48 and through blower 48 to exhaust conduit 52. The internal air is then exhausted from dryer appliance 10 via the outlet 53.

In some embodiments, an external duct 96 is provided in fluid communication with exhaust conduit 52. For instance, external duct 96 may be attached (e.g., directly or indirectly attached) to cabinet 12 at rear panel 16. Any suitable connector (e.g., collar, clamp, etc.) may join external duct 96 to exhaust conduit 52. In turn, external duct 96 may be downstream from outlet 42. When assembled, duct inlet 97 is positioned proximate to cabinet 12 and outlet 42 while duct outlet 98 is positioned distal to cabinet 12. In residential environments, duct outlet 98 may be positioned at or in communication with an outdoor environment (e.g., outside of a home or building in which dryer appliance 10 is installed). During a dry cycle, internal air may thus flow from exhaust conduit 52 to duct inlet 97; and from duct inlet 97 to duct outlet 98, before being exhausted to the outdoor environment.

In exemplary embodiments, vent duct 66 may include a filter portion 70 and an exhaust portion 72. Exhaust portion 72 may be positioned downstream of filter portion 70 (in the direction of flow of the internal air). A screen filter of filter portion 70 (which may be removable) traps lint and other foreign materials as the internal air flows therethrough. The internal air may then flow through exhaust portion 72 and blower 48 to ducted conduit 68 and, subsequently, external duct 96. After the clothing articles have been dried, the clothing articles are removed from drum 26 via entry 32. A door 33 provides for closing or accessing drum 26 through entry 32.

One or more selector inputs 80, such as knobs, buttons, touchscreen interfaces, etc., may be provided on a cabinet backsplash 81 and in communication with a processing device or controller 82. Signals generated in controller 82 operate motors 31 and 35 and heating assembly 40 (including heater 43) in response to the position of selector inputs 80. Additionally, a display 84, such as an indicator light or a screen, may be provided on cabinet backsplash 81. Display 84 may be in communication with controller 82, and may display information in response to signals from controller 82. As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements (e.g., non-transitive storage media) such as, for example, electrically erasable, programmable read only memory (EEPROM). The memory elements can store information accessible processing device, including instructions that can be executed by processing device. For example, the instructions can be software or any set of instructions that when executed by the processing device, cause the processing device to perform operations. In certain embodiments, the instructions include a software package configured to operate appliance 10.

Figure 3:
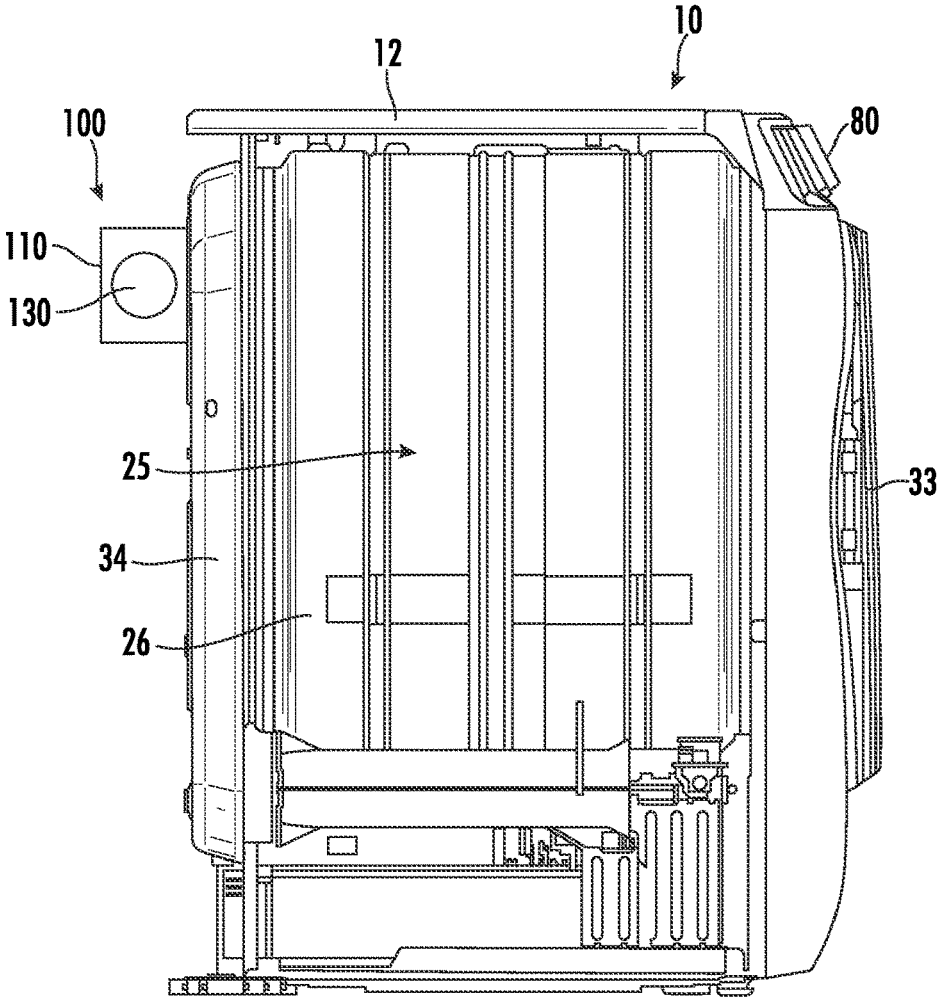
FIG. 3 is a section view of a dryer appliance in accordance with an example embodiment of the present disclosure.

Dryer appliance 10 may also include features for automated dispensing of dryer sheets into chamber 25. As shown in FIG. 3, dryer appliance 10 may include a sheet dispenser 100. Sheet dispenser 100 may be loaded with a plurality of dryer sheets, and sheet dispenser 100 may be configured for selectively dispensing the dryer sheets into chamber 25. For instance, prior to each drying cycle of dryer appliance 10, sheet dispenser 100 may add one or more dryer sheets into chamber 25. Thus, sheet dispenser 100 advantageously avoid or limit drying cycles without dryer sheets within chamber 25.

Sheet dispenser 100 may be mounted at cabinet 12. For instance, as shown in FIG. 3, sheet dispenser 100 may be mounted on rear wall 34. Thus, sheet dispenser 100 may be fixed relative to cabinet 12 rather than rotatable with drum 26. In alternative example embodiments, sheet dispenser 100 may be mounted proximate front end 37 of drum 26 or on other components within cabinet 12. In addition, while shown in FIG. 3 extending outwardly from cabinet 12 at rear wall 34, it will be understood that sheet dispenser 100 may be disposed within cabinet 12 in alternative example embodiments.

Sheet dispenser 100 may include a housing 110, a roller 120, and a motor 130. Housing 110 may define a storage volume 112 and an outlet 114. Storage volume 112 may be configured for receipt of a plurality of dryer sheets SS. As shown in FIG. 4, housing 110 may include various wall having a hexahedron shape, such as a rectangular cuboid shape. The storage volume 112 may be sized for receipt of a suitable number of dryer sheets SS. For instance, storage volume 112 may be sized for receipt of no less than fifty (50) dryer sheets SS, no less than one hundred (100) dryer sheets SS, no less than two hundred (200) dryer sheets SS, etc. Storage volume 112 may be configured for receiving dryer sheets SS as a vertical stack within storage volume 112. Sheet dispenser 100 may be configured for dispensing dryer sheets SS out of storage volume 112 via outlet 114. Outlet 114 may be positioned contiguous with chamber 25. Thus, housing 110 may be mounted within or on cabinet 12 such that dryer sheets SS passing out of storage volume 112 through outlet 114 enter chamber 25 during operation of sheet dispenser 100.

Roller 120 may be mounted to housing 110 within storage volume 112. For example, opposite ends of roller 120 may be positioned at and/or received in slots 116 defined in housing 110, e.g., which extend along the vertical direction V. Moreover, roller 120 may be rotatably mounted to housing 110. Roller 120 may engage and/or contact dryer sheets SS within storage volume 112. As discussed in greater detail below, rotation of roller 120 may urge dryer sheets SS within storage volume 112 to outlet 114. An outer surface of roller 120 may include a plurality of projections 122 distributed over the outer surface of roller 120. Projections 122 may assist with gripping or engaging dryer sheets SS within storage volume 112. In alternative example embodiments, roller 120 may include other features or textures for gripping or engaging dryer sheets SS within storage volume 112. Projections 122 or other surface features for roller 120 may advantageously assist with dispensing dryer sheets SS from storage volume 112 at a controller rate.

Roller 120 may also include other features for facilitating engagement between roller 120 and dryer sheets SS within storage volume 112. For example, a mass of roller 120 may be no less than two-tenths of a kilogram (0.2 kg). As another example, the mass of roller 120 may be no less than one kilogram (1 kg). Such sizing of roller 120 may facilitate engagement between roller 120 and dryer sheets SS within storage volume 112. Moreover, the mass or weight of roller 120 may be selected such that roller 120 is pressed onto or against a topmost one of the dryer sheets SS within storage volume 112 by the mass or weight of roller 120. In addition, sheet dispenser 100 may further include a spring 124 coupled to roller 120. Spring 124 may be configured to urge roller 120 against the topmost one dryer sheets SS in storage volume 112.

Motor 130 may be coupled to roller 120, and motor 130 may be operable to rotate roller 120. Motor 130 may be coupled directly to a rotor or motor 130 or may be indirectly coupled to motor 130 via a transmission, gearing, a belt, a chain, etc. By rotating roller 120, motor 130 may selectively dispense dryer sheets SS in storage volume 112. Moreover, when motor 130 rotates roller 120, roller 120 may urge dryer sheets SS in storage volume 112 towards drying chamber 25 through outlet 114 of housing 110. Motor 130 may be a stepper motor in certain example embodiments.

Controller 82 (or another suitable controller) may be in operative communication with motor 130. Thus, controller 82 may selectively activate motor 130 to rotate roller 120 and dispenser dryer sheets SS. When motor 130 is a stepper motor, controller 82 may be configured to operate the stepper motor a number of steps based at least in part on a determined number of dryer sheets SS to be dispensed. For example, when a large load of articles is placed within chamber 25 for drying, a user of dryer appliance 10 may enter a large load input via selector inputs 80, and controller 82 may command the stepper motor to rotate a relatively large number of steps in order to dispense multiple dryer sheets SS into chamber 25 from sheet dispenser 100. Conversely, when a small load of articles is placed within chamber 25 for drying, the user of dryer appliance 10 may enter a small load input via selector inputs 80, and controller 82 may command the stepper motor to rotate a relatively small number of steps in order to dispense a single dryer sheet SS into chamber 25 from sheet dispenser 100. It will be understood that a sensor, such as a camera, weight sensor, etc. may also be used to detect the load size within chamber 25. As may be seen from the above, controller 82 may operate the stepper motor to dispense one or more of dryer sheets SS from sheet dispenser 100 based at least in part upon a load size within chamber 25. Controller 82 may also operate motor 130 to dispense one or more of dryer sheets SS at an advantageous time during the drying cycle, e.g., at a beginning, middle, or end portion of the drying cycle.

The present subject matter may advantageously provide a dispenser for dryer sheets that avoid the time consuming and inconvenient process for manually adding dryer sheets for each load within a dryer appliance. The sheet dispenser of the present subject matter may automatically dispense dryer sheets or softening material during each drying cycle of the dryer appliance. Moreover, the sheet dispenser may assist with dispensing the proper amount of dryer sheets for each drying cycle, e.g., on a cycle-by-cycle basis. Thus, the sheet dispenser may advantageously avoid waste in smaller loads and/or improve efficacy in larger loads. The sheet dispenser may also provide a user of the dryer appliance with a "set it and forget it" drying cycle without the need to remember to add the dryer sheet. The sheet dispenser may also track usage of the dryer sheets to assist with re-ordering of dryer sheets as needed.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance, comprising:

a cabinet;

a drum rotatably mounted at the cabinet, the drum defining a drying chamber configured for receipt of articles for drying, the drum comprising a rear wall, the rear wall of the drum being fixed to the cabinet; and a sheet dispenser comprising a housing mounted to the rear wall of the drum, the housing defining a storage volume and an outlet, the storage volume configured for receipt of a plurality of dryer sheets for dispensing, the outlet positioned contiguous with the drying chamber, a roller mounted to the housing within the storage volume, and a motor coupled to the roller such that the motor is operable to rotate the roller, the roller configured to urge the plurality of dryer sheets in the storage volume towards the drying chamber through the outlet of the housing when the motor rotates the roller.

2. The dryer appliance of claim 1, wherein the storage volume of the housing is configured for receiving the plurality of dryer sheets as a vertical stack.

3. The dryer appliance of claim 1, wherein an outer surface of the roller comprises a plurality of projections distributed over the outer surface of the roller.

4. The dryer appliance of claim 1, wherein a mass of the roller is no less than two-tenths of a kilogram.

5. The dryer appliance of claim 4, wherein the mass of the roller is no less than one kilogram.

6. The dryer appliance of claim 1, wherein the sheet dispenser further comprises a spring coupled to the roller, the spring configured to urge the roller against a topmost one of the plurality of dryer sheets in the storage volume.

7. The dryer appliance of claim 1, further comprising a controller, wherein the motor is a stepper motor, the controller in operative communication with the stepper motor, the controller configured to operate the stepper motor a number of steps based at least in part on a determined number of sheets for dispensing.

8. A sheet dispenser for a dryer appliance, the dryer appliance comprising a drum, the drum defining a drying chamber configured for receipt of articles for drying, the drum comprising a rear wall, the sheet dispenser comprising:

a housing mounted to the rear wall of the drum, the housing defining a storage volume and an outlet, the storage volume configured for receipt of a plurality of dryer sheets for dispensing, the outlet positioned contiguous with the drying chamber;

a roller mounted to the housing within the storage volume; and a motor coupled to the roller such that the motor is operable to rotate the roller, the roller configured to urge the plurality of dryer sheets in the storage volume through the outlet of the housing when the motor rotates the roller.

9. The sheet dispenser of claim 8, wherein the storage volume of the housing is configured for receiving the plurality of dryer sheets as a vertical stack.

10. The sheet dispenser of claim 8, wherein an outer surface of the roller comprises a plurality of projections distributed over the outer surface of the roller.

11. The sheet dispenser of claim 8, wherein a mass of the roller is no less than two-tenths of a kilogram.

12. The sheet dispenser of claim 11, wherein a mass of the roller is no less than one kilogram.

13. The sheet dispenser of claim 8, wherein the sheet dispenser further comprises a spring coupled to the roller, the spring configured to urge the roller against a topmost one of the plurality of dryer sheets in the storage volume.

14. The sheet dispenser of claim 8, further comprising a controller, wherein the motor is a stepper motor, the controller in operative communication with the stepper motor, the controller configured to operate the stepper motor a number of steps based at least in part on a determined number of sheets for dispensing.

* * * * *